US008216479B2

(12) United States Patent
Lambert, V et al.

(10) Patent No.: US 8,216,479 B2
(45) Date of Patent: Jul. 10, 2012

(54) STORMWATER FILTER AND MOUNT ASSEMBLY

(75) Inventors: Jordan W. Lambert, V, Aumsville, OR (US); James H. Lenhart, Jr., Protland, OR (US); Daniel W. Aberle, Portland, OR (US)

(73) Assignee: Contech Stormwater Solutions LLC, West Chester, OH (US)

( * ) Notice: Subject to any disclaimer, the term of this patent is extended or adjusted under 35 U.S.C. 154(b) by 1358 days.

(21) Appl. No.: 11/842,607

(22) Filed: Aug. 21, 2007

(65) Prior Publication Data

US 2008/0047886 A1 Feb. 28, 2008

Related U.S. Application Data

(60) Provisional application No. 60/839,501, filed on Aug. 23, 2006.

(51) Int. Cl.
*B01D 35/027* (2006.01)
*B01D 37/00* (2006.01)
*C02F 1/00* (2006.01)

(52) U.S. Cl. ..... 210/747.3; 210/170.03; 210/232; 210/434; 405/43

(58) Field of Classification Search ..... None
See application file for complete search history.

(56) References Cited

U.S. PATENT DOCUMENTS

| | | | | | |
|---|---|---|---|---|---|
| 122,209 | A | * | 12/1871 | Ashman | 210/163 |
| 530,816 | A | * | 12/1894 | Wright | 210/247 |
| 739,249 | A | * | 9/1903 | Woods | 210/451 |
| 2,711,223 | A | * | 6/1955 | Temple | 210/170.03 |
| 2,796,176 | A | * | 6/1957 | Monson | 210/261 |
| 3,060,693 | A | * | 10/1962 | Taylor | 405/43 |
| 3,501,007 | A | * | 3/1970 | Davis | 210/170.01 |
| 4,689,145 | A | | 8/1987 | Mathews et al. | |
| 4,720,209 | A | | 1/1988 | Iams | |
| 4,923,330 | A | * | 5/1990 | DeTommaso | 405/36 |
| 4,982,533 | A | * | 1/1991 | Florence | 52/169.5 |
| 4,986,699 | A | | 1/1991 | Bohnhoff | |
| 5,062,735 | A | * | 11/1991 | Gaudin | 404/25 |
| 5,086,594 | A | * | 2/1992 | Florence | 52/169.5 |
| 5,106,440 | A | * | 4/1992 | Tangeman | 156/94 |
| 5,131,196 | A | * | 7/1992 | Florence | 52/169.5 |

(Continued)

FOREIGN PATENT DOCUMENTS

DE 19500171 A1 7/1996

(Continued)

OTHER PUBLICATIONS

International Search Report, dated Dec. 17, 2007; PCT/US2007/076363.

(Continued)

*Primary Examiner* — Robert James Popovics
(74) *Attorney, Agent, or Firm* — Thompson Hine LLP

(57) ABSTRACT

A stormwater filtration system includes a dry well structure including a top having an access opening, a bottom and a sidewall extending between the top and the bottom to define an internal volume of the dry well structure. A deck assembly partitions the dry well structure into an upper region and a lower region. The deck assembly includes a plurality of deck members sized to be delivered through the access opening of the dry well structure and configured to be assembled within the internal volume to form the deck assembly.

11 Claims, 7 Drawing Sheets

U.S. PATENT DOCUMENTS 5,195,284 A * 3/1993 Florence ..... 52/169.5
5,198,113 A 3/1993 Daniels
5,249,885 A * 10/1993 Florence ..... 405/44
5,419,838 A 5/1995 DiTullio
5,427,679 A 6/1995 Daniels
5,466,092 A 11/1995 Semenza et al.
5,511,904 A * 4/1996 Van Egmond ..... 405/52
5,562,819 A 10/1996 Turner, Jr. et al.
5,645,732 A 7/1997 Daniels
5,650,065 A * 7/1997 Sewell ..... 210/166
6,062,767 A * 5/2000 Kizhnerman et al. ..... 405/39
6,079,903 A 6/2000 Wagner et al.
6,161,985 A * 12/2000 Hinkle et al. ..... 404/26
6,190,545 B1 2/2001 Williamson
6,200,484 B1 3/2001 McInnis
6,226,928 B1 * 5/2001 Trangsrud ..... 52/20
6,241,881 B1 6/2001 Pezzaniti
6,251,269 B1 6/2001 Johnson et al.
6,254,770 B1 * 7/2001 Remon ..... 210/163
6,537,447 B2 * 3/2003 Remon ..... 210/163
6,613,228 B2 * 9/2003 Petersen et al. ..... 210/541
6,659,368 B2 12/2003 Capps
6,743,354 B1 * 6/2004 Evans et al. ..... 210/164
6,743,360 B2 * 6/2004 Petersen et al. ..... 210/541
6,793,811 B1 * 9/2004 Fleischmann ..... 210/163
6,908,548 B1 * 6/2005 Bruso et al. ..... 210/151
7,025,076 B2 4/2006 Zimmerman, Jr. et al.
7,033,110 B2 4/2006 Parker
7,041,213 B1 * 5/2006 McClanahan ..... 210/85
7,083,721 B2 * 8/2006 McClure et al. ..... 210/155
7,186,333 B2 * 3/2007 Kluge ..... 210/164
7,223,051 B1 * 5/2007 Vought et al. ..... 405/184.1
7,387,467 B2 * 6/2008 Kelty ..... 405/36
7,485,218 B2 * 2/2009 Dussich, I ..... 210/164
7,503,725 B1 * 3/2009 Pratt et al. ..... 405/50
7,540,953 B2 * 6/2009 Fitzgerald ..... 210/162
7,645,390 B1 * 1/2010 McClanahan ..... 210/739
7,670,483 B2 * 3/2010 Ringenbach et al. ..... 210/163
7,758,747 B2 * 7/2010 Bryant ..... 210/162
7,959,799 B2 * 6/2011 Happel et al. ..... 210/163
7,988,870 B2 * 8/2011 Belasco ..... 210/801
8,002,977 B2 * 8/2011 Shaw et al. ..... 210/164
8,012,346 B2 * 9/2011 Peters et al. ..... 210/170.03
8,017,006 B2 * 9/2011 Lopez ..... 210/163
8,021,543 B2 * 9/2011 Ghalib ..... 210/155
8,034,237 B2 * 10/2011 Happel et al. ..... 210/170.03
8,043,498 B2 * 10/2011 Rueda ..... 210/164
8,051,568 B2 * 11/2011 Moody et al. ..... 29/896.62
8,123,935 B2 * 2/2012 Murray et al. ..... 210/108
8,137,564 B2 * 3/2012 Gannon ..... 210/691
2001/0030150 A1 * 10/2001 Remon ..... 210/163
2002/0023864 A1 * 2/2002 Petersen et al. ..... 210/163
2003/0094407 A1 5/2003 De Ridder et al.
2003/0200708 A1 10/2003 Parker
2004/0007512 A1 * 1/2004 Petersen et al. ..... 210/163
2004/0040598 A1 3/2004 Zimmerman, Jr. et al.
2004/0091320 A1 5/2004 Parker
2004/0112807 A1 6/2004 Aberle et al.
2005/0058510 A1 3/2005 Parker
2005/0175419 A1 8/2005 Parker
2006/0102543 A1 * 5/2006 Peters et al. ..... 210/170
2006/0207922 A1 * 9/2006 Dussich ..... 210/164
2007/0147960 A1 * 6/2007 Kelty ..... 405/36
2008/0047886 A1 * 2/2008 Lambert et al. ..... 210/163
2009/0039022 A1 * 2/2009 Belasco ..... 210/651
2009/0045128 A1 * 2/2009 Murray et al. ..... 210/340
2009/0045149 A1 * 2/2009 Murray et al. ..... 210/785
2009/0107899 A1 * 4/2009 Ringenbach et al. ..... 210/164
2009/0166278 A1 * 7/2009 Bryant ..... 210/170.03
2010/0108839 A1 * 5/2010 Ringenbach et al. .... 248/225.11
2010/0187188 A1 * 7/2010 Ghalib ..... 210/764
2011/0155672 A1 * 6/2011 McInnis et al. ..... 210/747.3

FOREIGN PATENT DOCUMENTS

WO WO 92/14005 A 8/1992

OTHER PUBLICATIONS

Written Opinion of International Searching Authority; dated Dec. 17, 2007; PCT/US2007/073636.

International Preliminary Report on Patentability, PCT/US2007/076363 (Mar. 5, 2009).

* cited by examiner

STORMWATER FILTER AND MOUNT ASSEMBLY

CROSS-REFERENCE TO RELATED APPLICATIONS

This application claims priority to U.S. Provisional Application No. 60/839,501, filed Aug. 23, 2006, the details of which are hereby incorporated by reference as if fully set forth herein.

TECHNICAL FIELD

The present application relates generally to a stormwater filter and mount assembly for mounting the stormwater filter at a desired location within a dry well.

BACKGROUND

Stormwater is rainwater plus particulate debris and dissolved materials that the rainwater carries along with it. In urban areas, rain that falls on the roofs of houses, collects on paved areas like driveways, roads and sidewalks is typically diverted through a system of pipes that is separate from the sewage system. Unlike sewage, stormwater was historically not treated, but flowed directly from streets and gutters into rivers, lakes and oceans.

Stormwater can be a form of diffuse or non-point source pollution. It can entrain pollutants, such as garbage, sediment, organic matter, heavy metals, and organic toxins, and flush them into receiving water bodies. As a consequence, natural bodies of water that receive stormwater may also receive pollutants capable of irreparable environmental harm.

The amount of stormwater pollution entering into such receiving bodies of water is related to the degree of urbanization in the surrounding area and the nature of the surrounding activities. Urbanization results in the covering of land with low-permeability structures, such as roadways, parking lots, and rooftops, which both generate large volumes of stormwater and accumulate pollutants. Since these types of surfaces do not allow rainfall to infiltrate, they allow the accumulated pollutants to be washed into stormwater drainage systems.

One known stormwater drainage system is a dry well. Dry wells may be formed by drilling or digging a vertical hole into the ground, for example, 10 to 30 or more feet deep, installing a structure or pipe with perforations in the wall of the structure or pipe and filling the hole around it with gravel. The stormwater flowing into this structure or pipe migrates out through the perforations and is returned to the ground after passing through the surrounding gravel.

A filtration system in the form of a buffer tank has been proposed to remove sediment and pollutants from the water prior to entering the dry well. Filters are used to remove the sediment and pollutants from the water as it passes through the buffer tank on its way to the dry well drain pipe.

SUMMARY

In an aspect, a stormwater filtration system includes a dry well structure including a top having an access opening, a bottom and a sidewall extending between the top and the bottom to define an internal volume of the dry well structure. A deck assembly partitions the dry well structure into an upper region and a lower region. The deck assembly includes a plurality of deck members sized to be delivered through the access opening of the dry well structure and configured to be assembled within the internal volume to form the deck assembly.

In another aspect, a method of providing a stormwater filtration system is provided. The method includes assembling a deck assembly within a dry well structure including a top having an access opening, a bottom and a sidewall extending between the top and the bottom to define an internal volume of the dry well structure. The deck assembly includes a plurality of deck members sized to be delivered through the access opening of the dry well structure. The deck assembly is supported within the dry well structure to partition the dry well structure into an upper region and a lower region.

The above-described aspects may have one or more of the following advantages. In some embodiments, the deck assembly is used to divide the dry well structure into an upper region into which relatively unfiltered stormwater flows and a lower region into which filtered stormwater flows. By filtering the stormwater prior to its reaching the lower region of the dry well, primarily filtered stormwater reaches the bottom of the dry well structure, which can simplify cleaning of the dry well, increase throughput of water through the dry well and reduce clogging of the dry well.

The details of one or more embodiments are set forth in the accompanying drawings and the description below. Other features, objects, and advantages will be apparent from the description and drawings, and from the claims.

DETAILED DESCRIPTION

Figure 1:
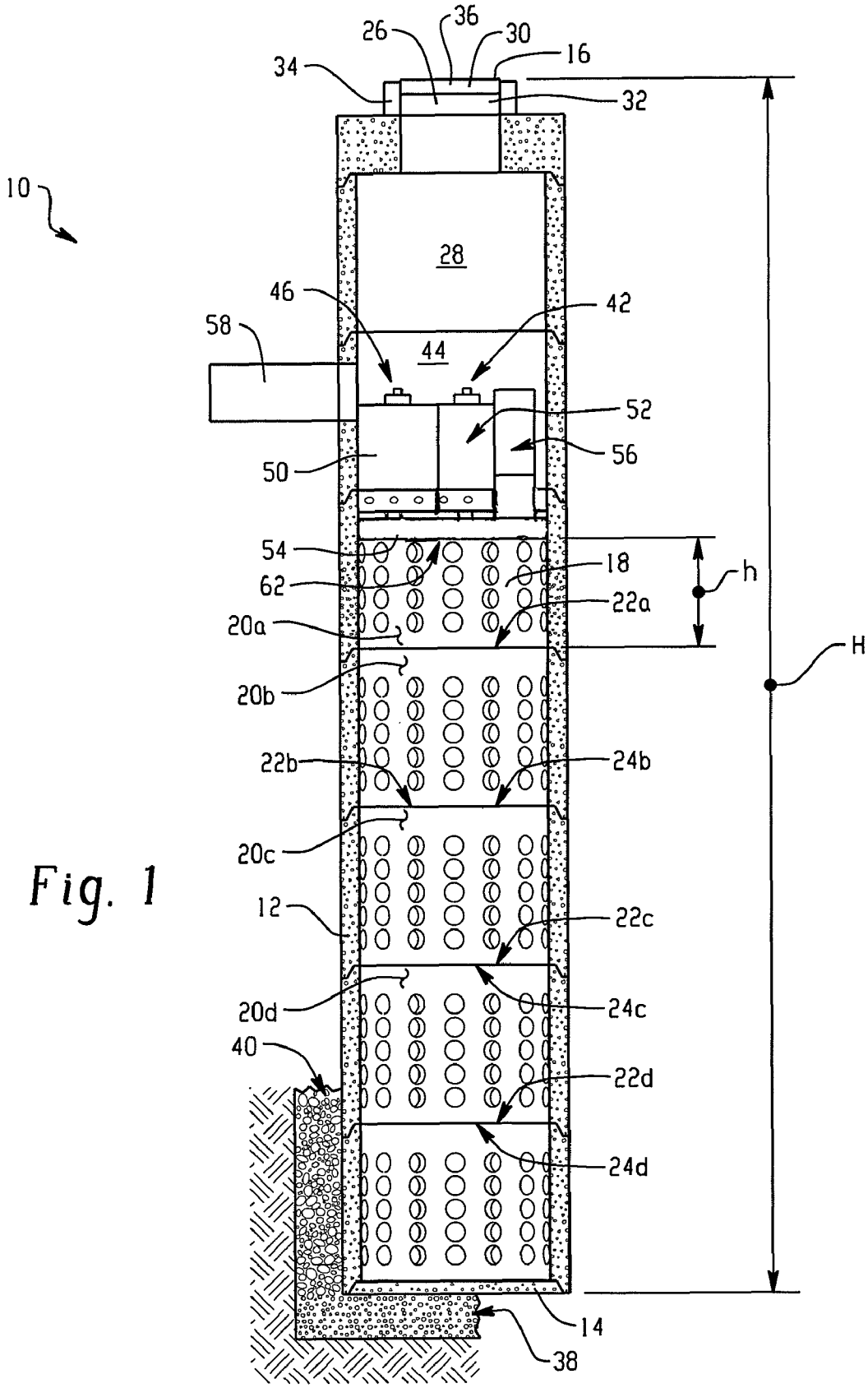
FIG. 1 is a diagrammatic section view of an embodiment of a dry well structure including an embodiment of a stormwater filter and mount assembly.

Referring to FIG. 1, a dry well structure 10 includes a wall 12 (e.g., formed of stacked, cylindrical concrete manhole sections), a base 14 and a top 16 that defines an internal volume 18 of the dry well structure. In some embodiments, the total height H of the dry well structure 10 is about 30 feet, however the height may be greater or less than 30 ft. Internal volume 18 of the dry well structure 10 is divided into multiple regions 20*a*-20*d* (e.g., each having a height h of about 5 ft.) by perforated sections 22*a*-22*d*. In the illustrated embodiment, the perforated sections 22*a*-22*d* each include a filter fabric 24*a*-24*d* that spans a gap between sides of the wall 12. An access opening 26 provides access to the internal volume 18. Access opening 26 is located atop a region 28. The access opening 26 has a diameter (e.g., between about 2 ft. and about 3 ft.) that is less than the diameter at regions 20*a*-20*d* (e.g., about 4 ft.). Access opening 26 may be closed by a cover assembly 30 including grade rings 32, frame 34 and cover 36 (e.g., formed of cast iron). A granular base material 38 is located at the base 14 of the dry well structure 10, while a rock backfill material 40 surrounds the periphery of the dry well structure.

A stormwater filter and mount assembly 42 is located between region 20*a* and region 44. Stormwater filter and mount assembly 42 includes a filter assembly 46 of multiple filter units 48, 50 and 52 (only filter units 50 and 52 can be seen), a mount assembly 54 that is used to support the filter assembly at the illustrated location within the internal volume 18, and an overflow conduit 56 (e.g., a 10 inch or 12 inch diameter 3034 PVC standpipe) that allows stormwater to bypass the filter units 48 at a predetermined water level (e.g., 21 inches above deck assembly 62). In some embodiments, the stormwater filter and mount assembly 42 is located near a stormwater inlet 58 through which stormwater enters the dry well structure 10. In some embodiments, it may be preferable to locate the stormwater filter and mount assembly 42 just below the inlet 58, yet close to the access opening 26 (e.g., about 10 ft. below the access opening) so that a person installing or performing maintenance on the stormwater filter and mount assembly will not have to descend far (e.g., about 15 ft. or more) into the dry well structure 10.

Figure 2:
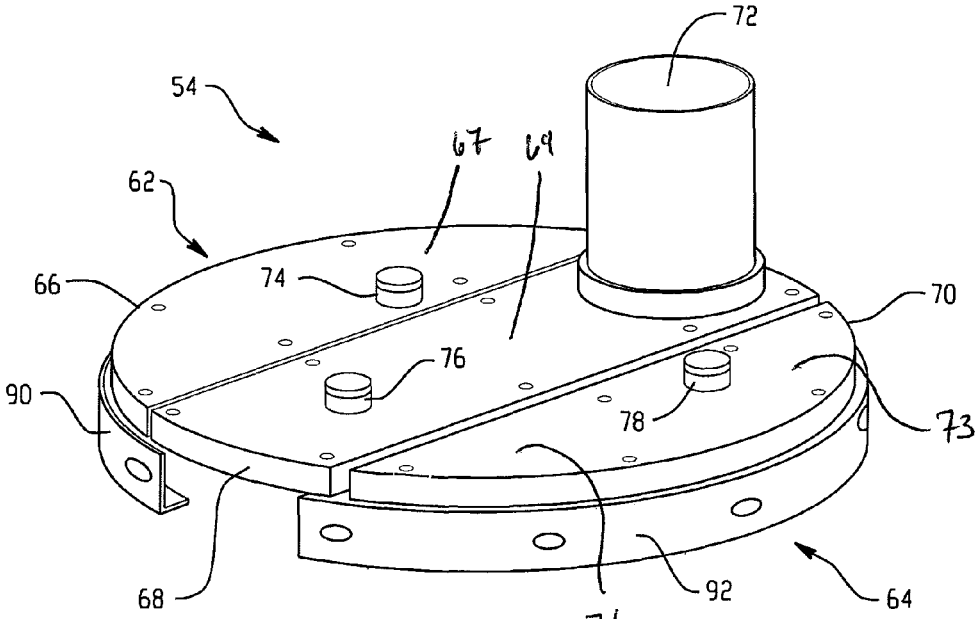
FIG. 2 is a perspective view of an embodiment of a mount assembly of the stormwater filter and mount assembly of FIG. 1.
Figure 3:
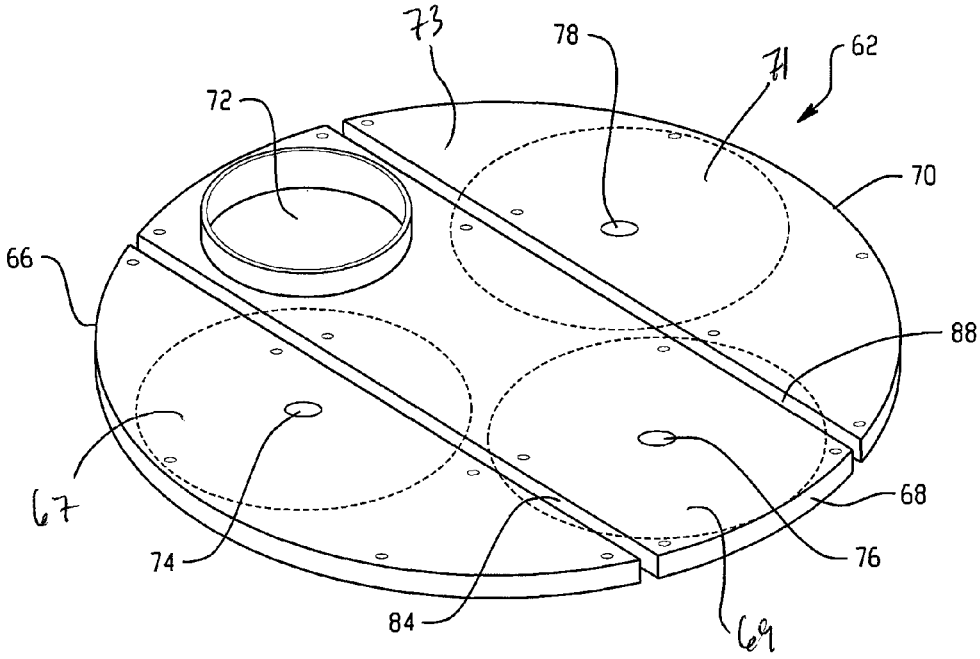
FIG. 3 is a perspective, top view of an embodiment of a deck assembly of the mount assembly of FIG. 2.
Figure 4:
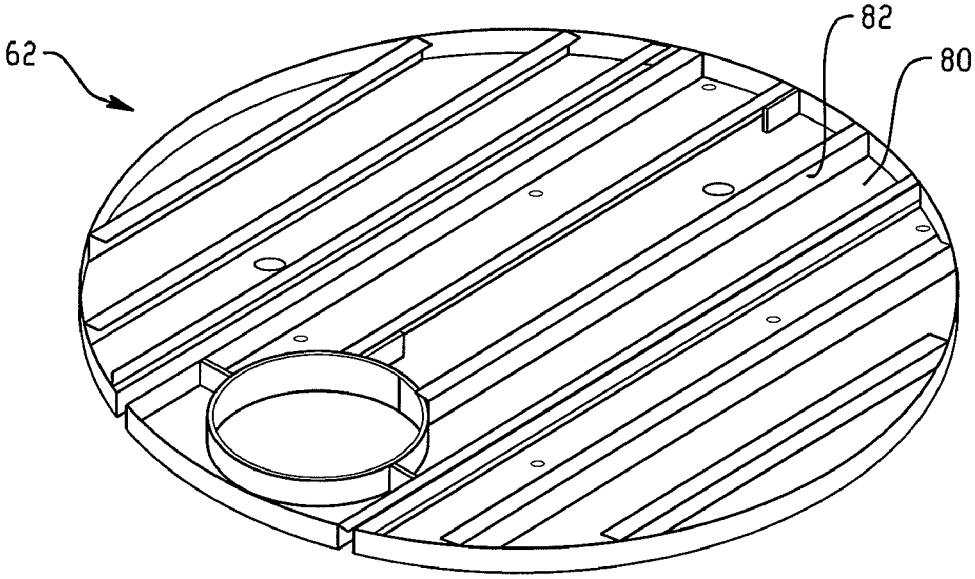
FIG. 4 is a perspective, bottom view of the deck assembly of FIG. 3.

Referring to FIG. 2, mount assembly 54 includes the deck assembly 62 and a deck support assembly 64. As can be best seen in FIG. 1, the deck assembly 62 has a width that is greater than that of the access opening 26. Referring to FIGS. 2 and 3, deck assembly 62 includes deck components 66, 68 and 70, overflow opening 72 sized to receive the overflow conduit 56 and filter unit outlet connectors 74, 76 and 78 that connect with the filter units 48, 50 and 52 (whose footprints are illustrated by the dotted lines) to allow filtered stormwater to pass from the filter units and travel down into the lower section of the dry well 10. The deck components 66, 68 and 70 may collectively be planking or beams, each having planar upper surfaces 67, 69 and 71 that cooperate, when assembled, to form a planar support surface 73 for the filter units 48, 50 and 52 having a diameter that is substantially the same as an inner diameter of the dry well structure 10. Referring to FIG. 4, bottom 80 of the deck assembly 62 includes multiple support structures, in the illustrated embodiment L-angle beams 82, to provide additional support for the static weight of the filter units 48, 50, 52 and any dynamic loading generated through human interaction with the stormwater filter and mount assembly 42.

Figure 5:
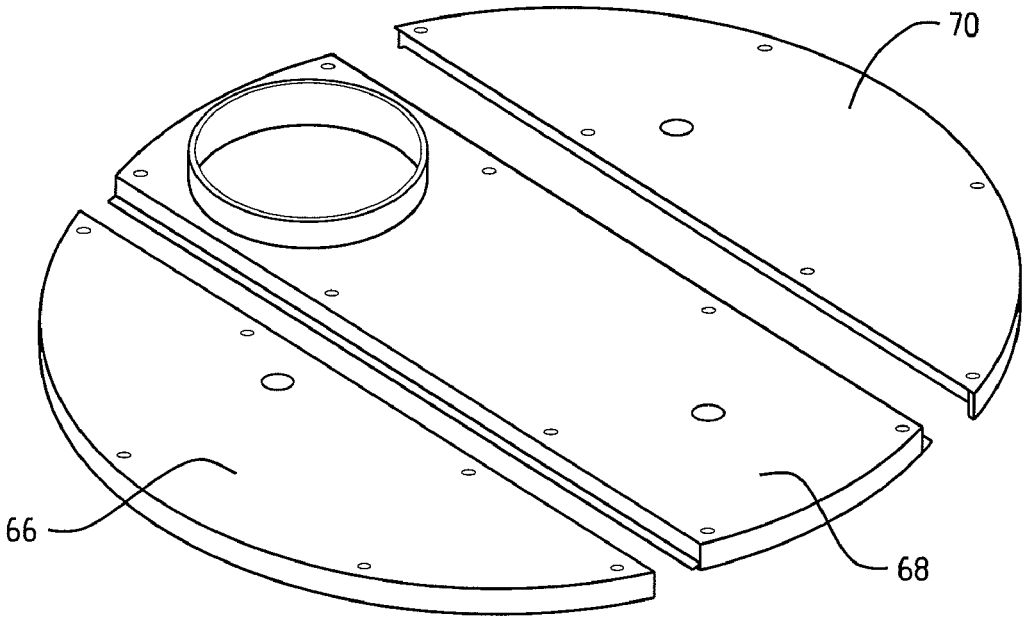
FIG. 5 is a perspective view of the deck assembly of FIG. 3 in an unassembled condition.

FIG. 5 shows the deck components 66, 68, 70 prior to their assembly to form the deck assembly 62. Prior to assembly, the deck components 66, 68, 70 are sized so that they can be carried or otherwise delivered through the access opening 26 of the dry well structure 10 (FIG. 1) and then assembled. The deck components 66, 68 and 70 may be assembled within the internal volume 18 using any suitable method or devices including adhesives, fasteners, welding, etc. The beams 82 may be already connected to the deck components 66, 68, 70 or they may be connected thereto after being delivered through the access opening 26. Any gaps or seams 84, 88 (FIG. 3) may be filled with a sealer, for example, a foam backing rod sealed with structural adhesive, such as Sikaflex®, so that the deck assembly provides a substantially water-impervious barrier upon which the filter assembly 46 rests.

Figure 6:
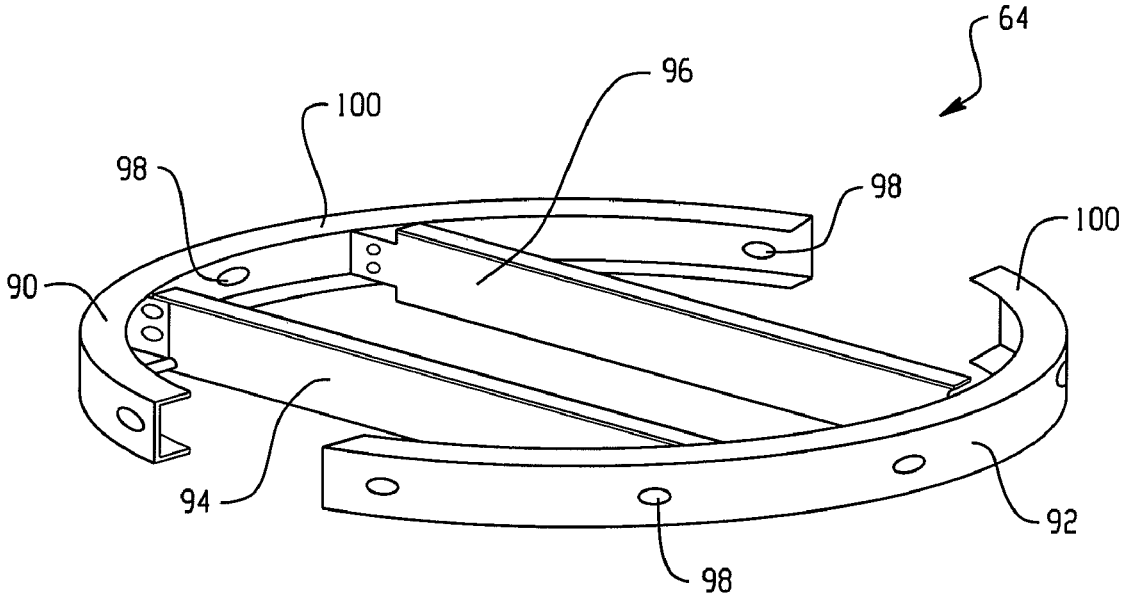
FIG. 6 is a perspective, top view of an embodiment of a deck support assembly of the mount assembly of FIG. 2.

Referring to FIG. 6, deck support assembly 64 is sized to be affixed to the wall 12 of the dry well structure 10. Deck support assembly 64 includes a first bracket member 90 and a second bracket member 92 that is connected to the first bracket member by connectors 94, 96 (e.g., beam supports). The first and second brackets, once connected, form a shape corresponding to that of the inner surface of the wall 12 of the dry well structure 10. In the illustrated embodiment, the first and second bracket members 90 and 92, when connected, define a generally circular outer surface that can abut and attach to the inner diameter of the concrete wall 12 to give structural support to the deck assembly 62.

Prior to connecting the first and second bracket members 90, 92 together, the first and second bracket members and connectors 94, 96 are sized to be carried or otherwise delivered through the access opening 26 of the dry well structure 10. In some embodiments, the bracket members 90 and 92 may first be attached to the wall 12 and then the connectors 94 and 96 connected to the bracket members, or the bracket members 90 and 92 may be connected together (as shown in FIG. 6) by the connectors 94 and 96 and then the bracket members may be attached to the wall 12. While the first and second bracket members 90, 92 are illustrated as U-shaped, they may be any suitable shape, such as L-shaped. The deck support assembly 64 may be assembled within the internal volume 18 using any suitable method or devices including adhesives, fasteners, welding, etc. and affixed to the wall 12. As one example, the first and second bracket members 90, 92 may include openings 98 through which concrete anchors may be inserted (e.g., 10½ inch by 3.5 inch concrete anchors). In one embodiment, a seal (e.g., a rubber strip) may be located (e.g., glued) on an upper surface 100 of the first and second bracket members 90, 92 to form a seal between the deck support assembly 64 and the deck assembly 62. Once the deck support assembly 64 is fully assembled and anchored to the wall 12 of the dry well structure 10 the deck assembly 62 may be placed thereon to form the mount assembly 54 of FIG. 2.

Any suitable materials may be used to form the mount assembly. In one embodiment, the deck components 66, 68, 70, first and second bracket members 90, 92 and connectors 94, 96 are formed of aluminum or an aluminum alloy such as Al 6061. Another suitable material for forming components includes mild steel, for example, that is rolled and powder coated.

Figure 7:
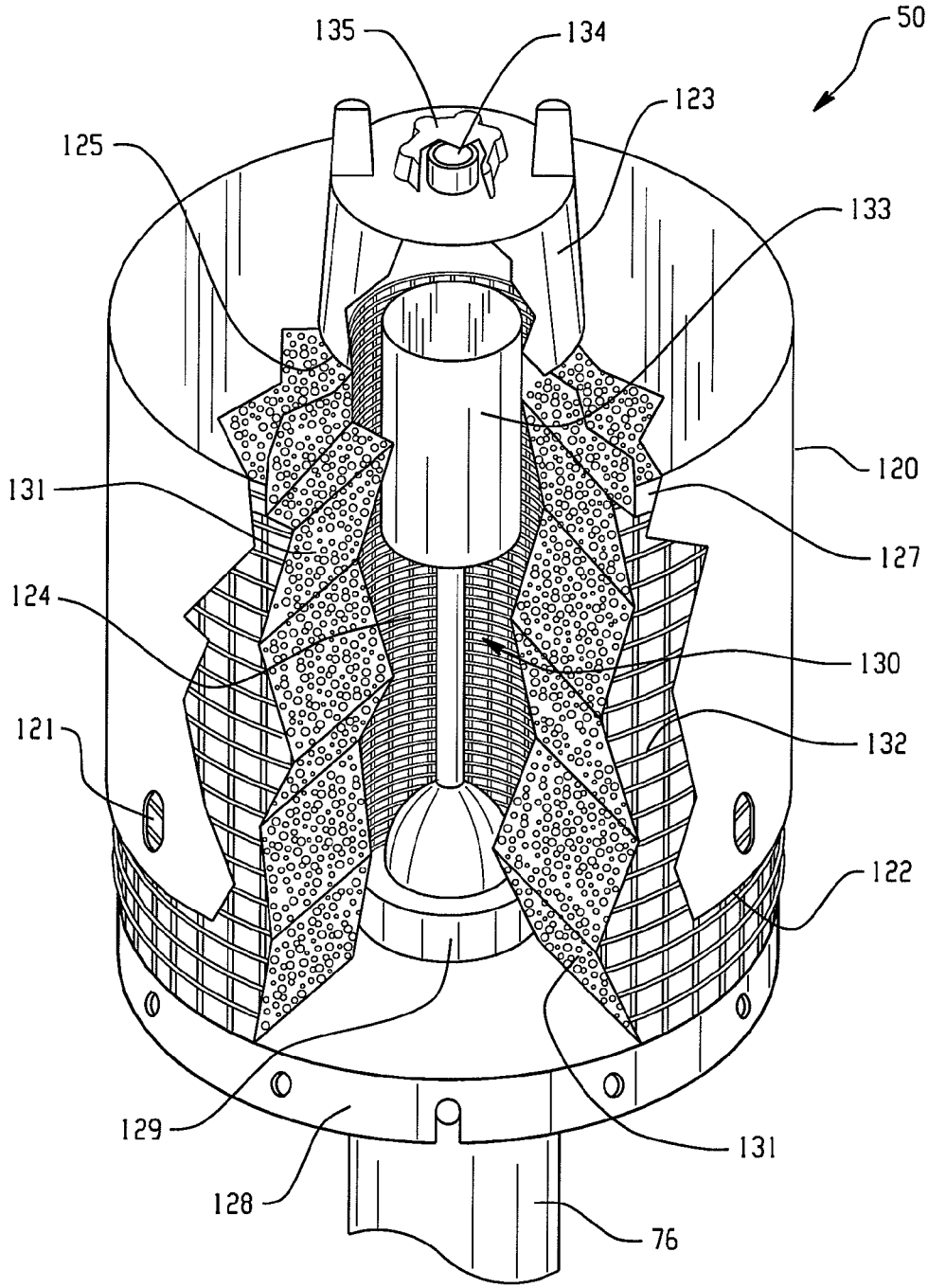
FIG. 7 is a section view of an embodiment of a filter unit of the stormwater filter and mount assembly of FIG. 1.

Referring now to FIG. 7, an exemplary filter unit 50 (this discussion of the filter unit 50 may apply equally to filter units 48 and 52) is defined by and substantially enclosed by a hood 120 that optionally includes a plurality of voids 121 to enhance regulated surface cleaning of a filter medium 131. Voids 121 may be arranged in a horizontally aligned array within the material of the hood 120, for example near a lower edge 122 of the hood.

Hood 120 is attached to the filter unit 50 via an inner drainage space cap 123, which engages an upward-extending end of an inner drainage space screen 124, that extends through the center of hood 120. The connection between the inner drainage space cap 123 and the hood 120 is sealed through the use of a hood gasket 125 of an appropriate sealing material, such as neoprene rubber. Hood 120 may be attached to an outer screen support screen 127 using one or more mechanical fasteners. Such fasteners may be seated against the hood 120 so that an airtight seal is developed. Alternatively, the hood 120 is secured satisfactorily by the inner drainage space cap 123, and additional perforations of the hood are minimized or eliminated.

The components of the filter unit 50 are supported by a base 128 (a circular base in the case of a cylindrical filter assembly) of water-impermeable material, preferably plastic. This base 128 is seated over a bushing 129 that serves as the connection point between the filter unit 50 and the connector 76, this bushing 129 being in fluid communication with inner drainage space 130, that is in turn in fluid communication with filter medium 131 that is disposed in an annular space surrounding the inner drainage space 130. The filter medium 131 is bounded by an outer screen 132 that is connected to the base 128 and supported at its upper extremity by the outer screen support ring 127, and inner drainage space screen 124 that defines the inner drainage space.

The connector 76 incorporated in the deck assembly 62 connects vertically to the base of the inner drainage space 130 via the bushing 129, which both allows the flow of treated stormwater out of the cartridge and serves as a component of a float valve assembly 133. This bushing 129 serves as the connection point between the filter unit 50 and the dry well structure 10, such that the base 128 overhangs the deck assembly 62. The inner drainage space cap 123 contains a mechanism to promote the development of a siphon by permitting air to be expelled from beneath the hood but preventing air from flowing back into the housing via the inner drainage space cap 123. This mechanism is typically one of a variety of one-way check valve designs. In a preferred embodiment, check valve 134 is an umbrella-type check valve that is installed atop the inner drainage space cap 123 and shielded by a check valve cap 135. Check valve cap 135 surrounds and protects the check valve from stormwater, as discussed in greater detail below.

The filter unit 50 generally relies on hydraulic pressure to force water through the filter medium and the filter assembly is therefore at least partially submerged in stormwater during normal operation. Stormwater can enter the filter assembly, infiltrating radially inward through the outer screen 132 and filter medium 131, and into the inner drainage space 130 for removal via the connector 76. Filtration occurs as the water is strained through, and comes into contact with, the filter medium. The filtered stormwater then passes through the connector 76 and down into the dry well structure 10 to be returned to the ground. Additional details of the filter unit 50 are described by the attached U.S. Publication No. 2004/0112807, titled Filter Cartridge With Check Valve Protection, filed Aug. 21, 2003.

Figure 8:
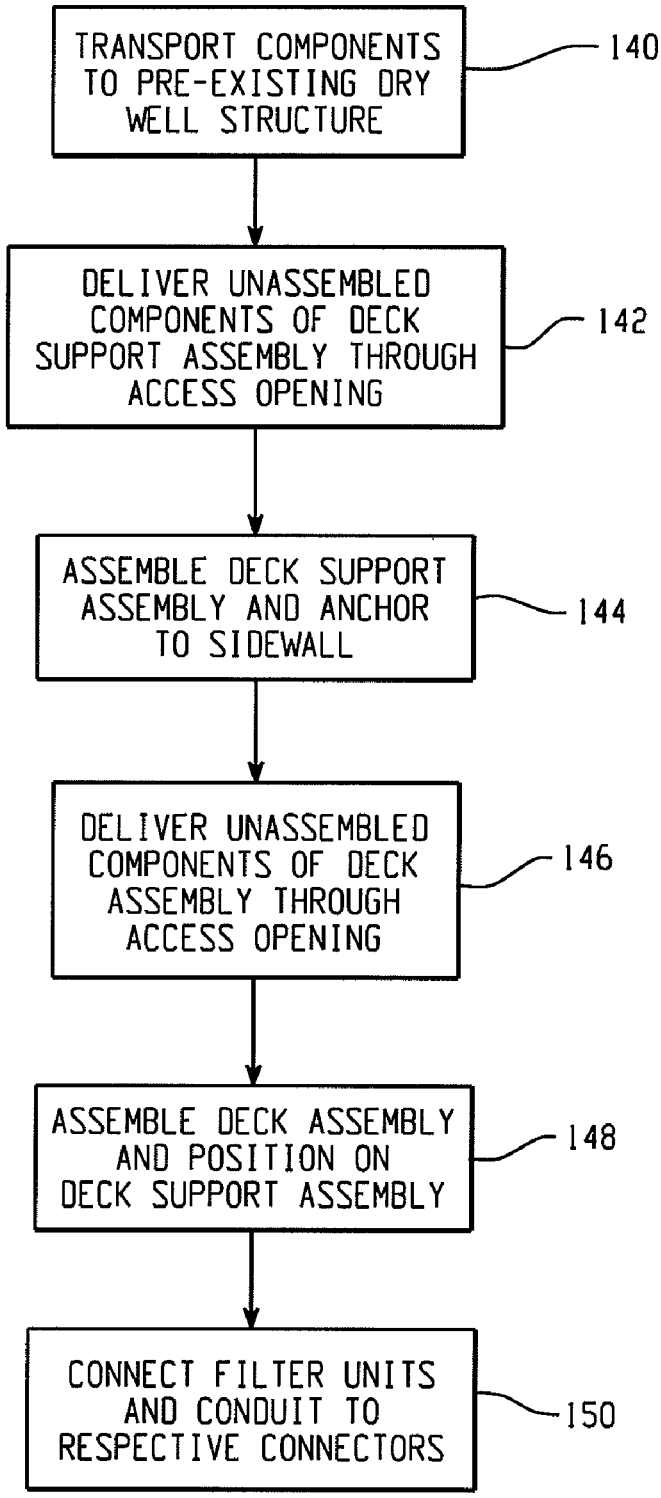
FIG. 8 is an embodiment of a method of installing the stormwater filter and mount assembly of FIG. 1 within the dry well structure.

FIG. 8 shows a method of installing the stormwater filter and mount assembly 42 within dry well structure 10. At step 140, the unassembled components of the deck assembly 62 and deck support assembly 64 are transported to a pre-existing dry well structure 10 (FIG. 1). The unassembled components of the deck support assembly 64 are delivered through the access opening 26 and into the internal volume 18 by an installer at step 142. At step 144, the installer assembles the deck support assembly 64 and anchors the deck support assembly 64 to the wall 12 of the dry well structure 10. At step 146, the installer delivers the unassembled components of the deck assembly 62 through the access opening 26 and into the internal volume 18. The unassembled components of the deck assembly 62 are assembled and the deck assembly is placed upon the deck support assembly 64 at step 148. At step 150, the filter units 48, 50 and 52 are connected to their respective connectors 74, 76 and 78 at a location above the deck assembly 62 and the overflow conduit 56 is connected to the overflow opening 72.

Figure 9:
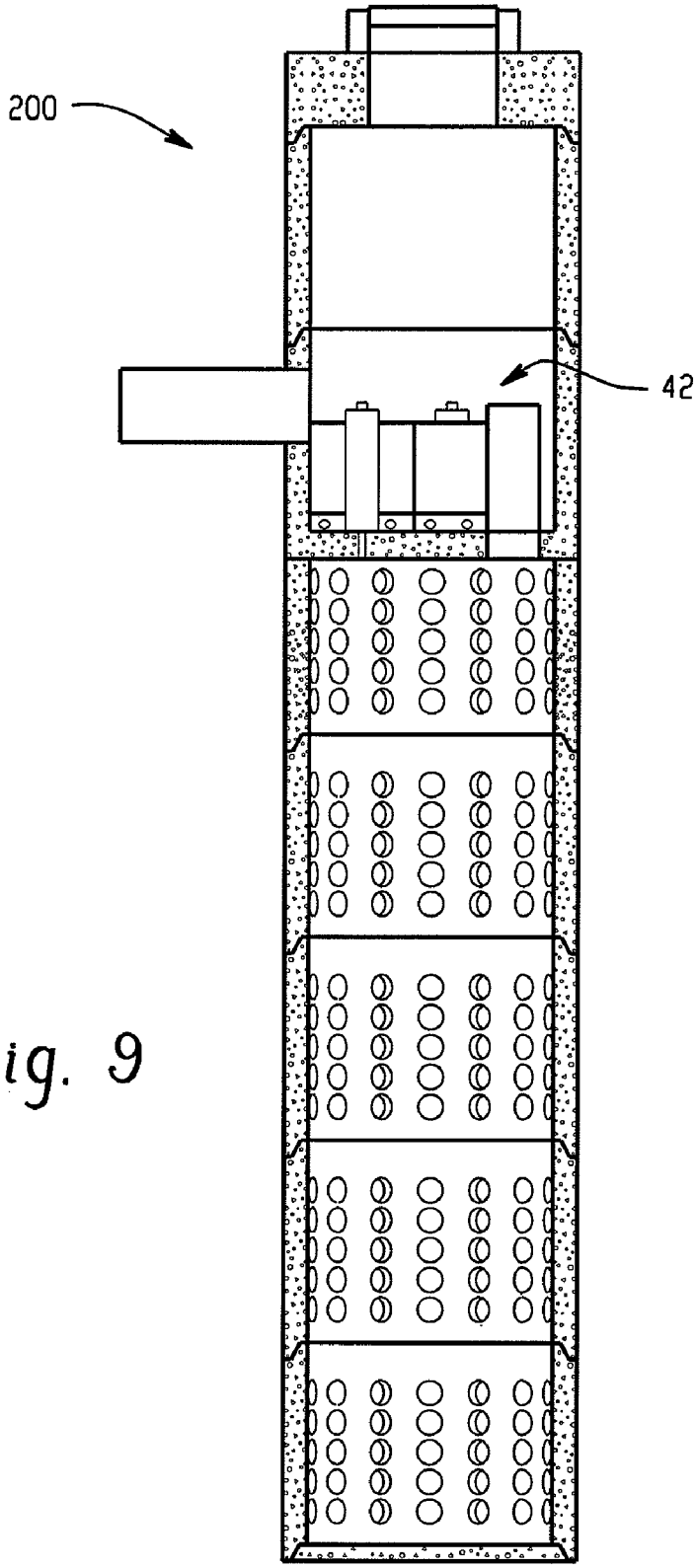
FIG. 9 is another embodiment of a storm well structure including a stormwater filter and mount assembly.

The above-described stormwater filter and mount assembly 42 can be retrofitted into existing dry well structures, for example, to comply with newly or recently instituted requirements. The multiple component design can allow for ease of installation and loose tolerances relating to the dry well structure can provide embedded installation flexibility. The span (e.g., diameter) of both the deck assembly and deck support assembly, once assembled, are near to the span (e.g., diameter) between opposing faces of the wall 12 of the dry well structure 10. By providing a deck assembly and deck support assembly each formed of multiple connectable components, the separate components can easily be delivered through the access opening which may have a span that is less than those of the deck assembly and/or deck support assembly once assembled. Referring to FIG. 9, the stormwater filter and mount assembly 42 may be connected to a precast dry well structure 200 in a fashion similar to that described above prior to (or after) placing the dry well structure 200 within the ground.

A number of detailed embodiments have been described. Nevertheless, it will be understood that various modifications may be made. For example, while three filter units are described above, more or less filter units may be used, for example, depending on flow requirements and size of the internal volume of the dry well structure.

What is claimed is:

1. A method of providing a stormwater filtration system within an existing dry well structure including a top having an access opening, a bottom and a sidewall extending between the top and the bottom to define an internal volume of the dry well structure, the sidewall being perforated along a portion of its height, said internal volume having a horizontal cross-sectional area that is greater than the cross-sectional area of said access opening, the method comprising:

assembling a deck assembly within the dry well structure, the deck assembly comprising a plurality of deck members sized to be delivered through the access opening of the dry well structure; and supporting the deck assembly within the dry well structure thereby partitioning the internal volume into an upper region and a lower region, where the deck assembly is supported within the dry well structure at a location such that in the upper region the sidewall is not perforated and in the lower region at least part of the sidewall is perforated, and mounting a filter cartridge atop the deck assembly to a filter cartridge connector defining an opening through the deck assembly.

2. The method of claim 1 comprising supporting the deck assembly within the dry well structure with a deck support assembly comprising a plurality of deck support components mounted to the sidewall and sized to be delivered through the access opening of the dry well structure.

3. The method of claim 2 further comprising assembling the deck support assembly within the internal volume of the dry well structure.

4. The method of claim 1 further comprising mounting a bypass conduit to the deck assembly for directing stormwater from the upper portion to the lower portion.

5. The method of claim 1 further comprising sealing gaps in the deck assembly using a sealer.

6. The method of claim 1, wherein the deck assembly is supported at a location of no more than about 15 feet from the access opening.

7. The method of claim 1, wherein the deck assembly, once assembled, has a width that is greater than a width of the access opening.

8. A method of providing a stormwater filtration system within a dry well structure, comprising:

providing a deck assembly including a plurality of deck members sized to be delivered through a top access opening of the dry well structure, where the top access opening is smaller than a diameter of the dry well structure as defined by a side wall of the dry well structure, the side wall of the dry well structure being perforated along a portion of its height;

passing the plurality of deck members of the deck assembly through top access opening in unassembled manner;

assembling the deck members of the deck assembly within the dry well structure to produce the deck assembly in a size that spans the diameter of the dry well structure;

supporting the deck assembly within the dry well structure thereby partitioning an internal volume of the dry well structure into an upper region and a lower region, where the deck assembly is supported within the dry well structure at a location such that in the upper region the sidewall is not perforated and in the lower region at least part of the sidewall is perforated; and mounting a filter cartridge to a filter cartridge connector defining an opening through the deck assembly.

9. The method of claim 8 comprising supporting the deck assembly within the dry well structure with a deck support assembly comprising a plurality of deck support components mounted to the sidewall and sized to be delivered through the access opening of the dry well structure, the method including passing the plurality of deck support components through the top access opening.

10. The method of claim 9 further comprising assembling the deck support assembly within the internal volume of the dry well structure.

11. A method of providing a stormwater filtration system within a pre-existing dry well structure having a top with an access opening and a sidewall extending from said top downward to a bottom of an internal volume of said dry well structure, said internal volume having a horizontal cross-sectional area that is greater than the cross-sectional area of said access opening, said sidewall being perforated along a portion of its height, said method comprising the steps of:

providing a plurality of deck assembly components and deck support components including at least two curved brackets members, each of which is sized to be delivered through said access opening;

passing said plurality of deck assembly components and deck support components through said access opening and into said internal volume;

assembling said deck assembly components within said internal volume to form a deck assembly, said deck assembly having a diameter that is substantially the same as an inner diameter of said dry well structure;

affixing said deck assembly to said sidewall using said support components such that the internal volume of said dry well structure is partitioned into an upper region in which the sidewall is not perforated and a lower region in which at least part of the sidewall is perforated;

with exception of component openings in said deck assembly, said deck assembly forming a substantially water-impervious barrier between said upper and lower regions;

connecting at least one filter unit to an opening in said deck assembly;

connecting an overflow conduit to an opening in said deck assembly; and allowing stormwater to enter said upper region, pass through said filter and flow into said lower region, thereby producing stormwater having fewer contaminants.

* * * * *